US005535104A

United States Patent [19]

Maffey et al.

[11] Patent Number: 5,535,104

[45] Date of Patent: Jul. 9, 1996

[54] REMOTELY ACTUATED DOOR LOCK LIGHT

[75] Inventors: George E. Maffey, Dana Point, Calif.; David A. Saar, Lawrenceville; Raymond W. Simpson, Hamilton Square, both of N.J.

[73] Assignee: Emhart Inc., Newark, Del.

[21] Appl. No.: 514,281

[22] Filed: Aug. 11, 1995

[51] Int. Cl.[6] ..... E05B 17/10

[52] U.S. Cl. ..... 362/100; 362/32; 340/542; 315/84

[58] Field of Search ..... 362/32, 101, 253, 362/94; 340/542, 543; 315/84

[56] References Cited

U.S. PATENT DOCUMENTS

| | | | |
|---|---|---|---|
| 3,955,075 | 5/1976 | Susedik | 362/100 |
| 4,234,909 | 11/1980 | Cotroneo | 362/100 |
| 4,310,873 | 1/1982 | Bean | 362/100 |
| 4,475,067 | 10/1984 | Rowe | 362/100 |
| 5,179,325 | 1/1993 | Aragon, Jr. | 362/100 |
| 5,398,175 | 3/1995 | Pea | 362/100 |

*Primary Examiner*—Denise L. Gromada
*Assistant Examiner*—Thomas M. Sember
*Attorney, Agent, or Firm*—Spencer T. Smith

[57] ABSTRACT

A door lock assembly comprising a lock plug having a key receiving opening, selectively operable light source for illuminating the key receiving opening, RF receiver for reproducing a received pulsed RF signal and means for determining whether the reproduced RF signal is within an acceptable range of asymmetric patterns of "on" pulse times followed by "off" times selected to include a plurality of different asymmetric patterns and means for operating the light source means for a selected period of time when the determining means determines that the reproduced RF signal is within acceptable range.

10 Claims, 9 Drawing Sheets

REMOTELY ACTUATED DOOR LOCK LIGHT

The present invention relates to secured doors of homes, businesses and the like and more particularly, to the illumination of the door lock area prior to door entry.

The have been numerous designs for turning on a light in the door lock to facilitate key usage including depressible buttons (U.S. Pat. Nos. 3,719,821, 4,310,873, 4,777,570, 5,057,975), a touch sensitive switch (U.S. Pat. No. 5,179,325) and a displacement sensor (U.S. Pat. No. 5,398,175).

It is an object of the present invention to provide a remotely actuated lockset light for illuminating the key opening of the lockset.

Other objects and advantages of the present invention will become apparent from the following portion of this specification and from the accompanying drawings which illustrate in accordance with the mandate of the patent statutes a presently preferred embodiment incorporating the principles of the invention.

Referring to the drawings.

Figure 1:
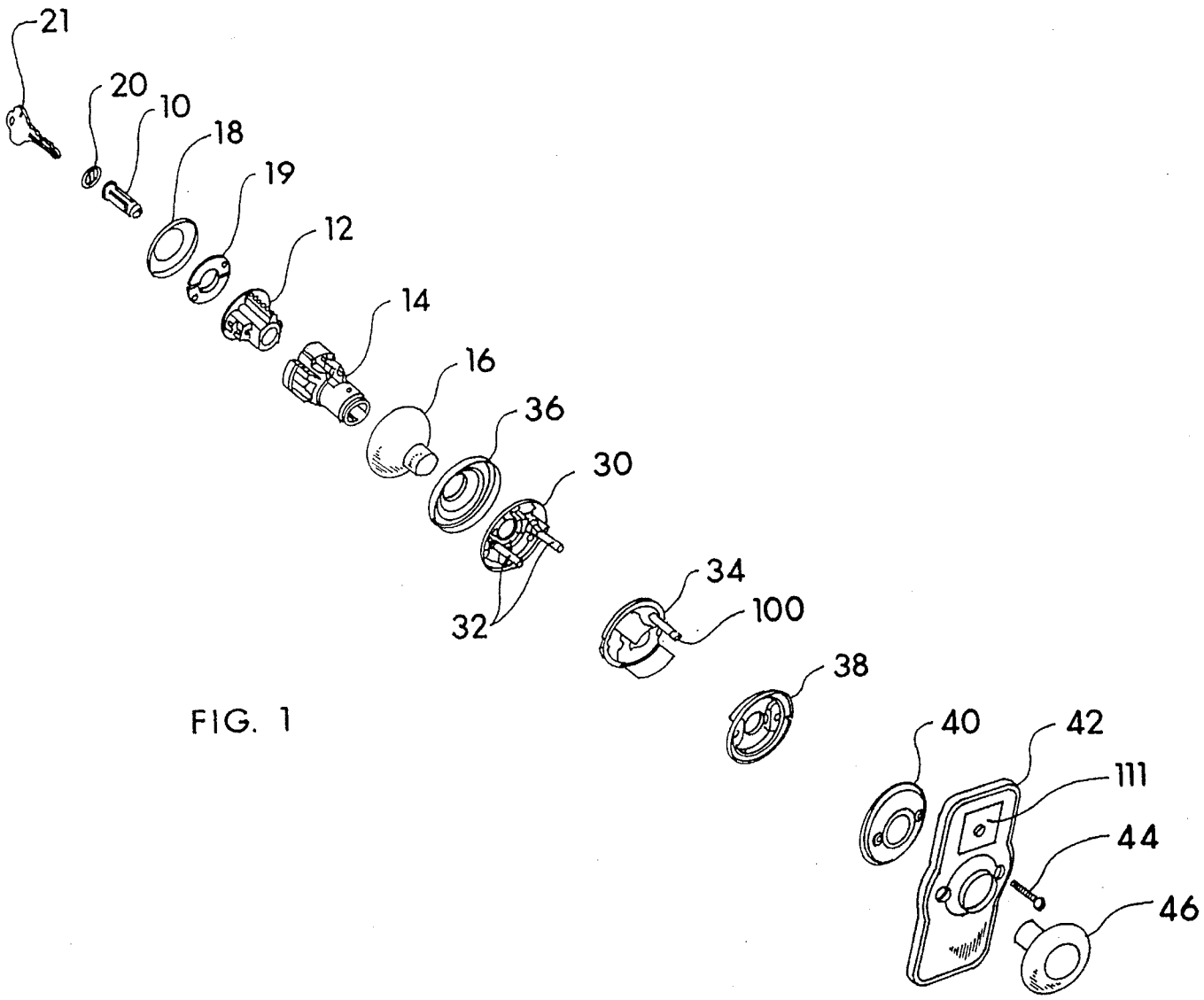
FIG. 1 is an oblique view of some of the parts of the lockset assembly made in accordance with the teachings of the present invention shown separated for clarity.

In a lockset the exterior operator assembly includes a key plug 10 inserted into a cylinder body 12 which is received by an insert 14 inserted into an exterior operator 16 (shown as a knob). The end of the cylinder is decorated with a cover 18 which captures an annular portion 19 made of clear plastic and the end of the plug 10 is decorated with another cover 20. To unlock this cylinder, a suitable key 21 is inserted into the plug.

The exterior operator assembly is connected to a conventional spindle assembly (not shown) which operates a conventional latch assembly (also not shown). Rotation of the operator accordingly operates the latch to open the door.

Figure 2:
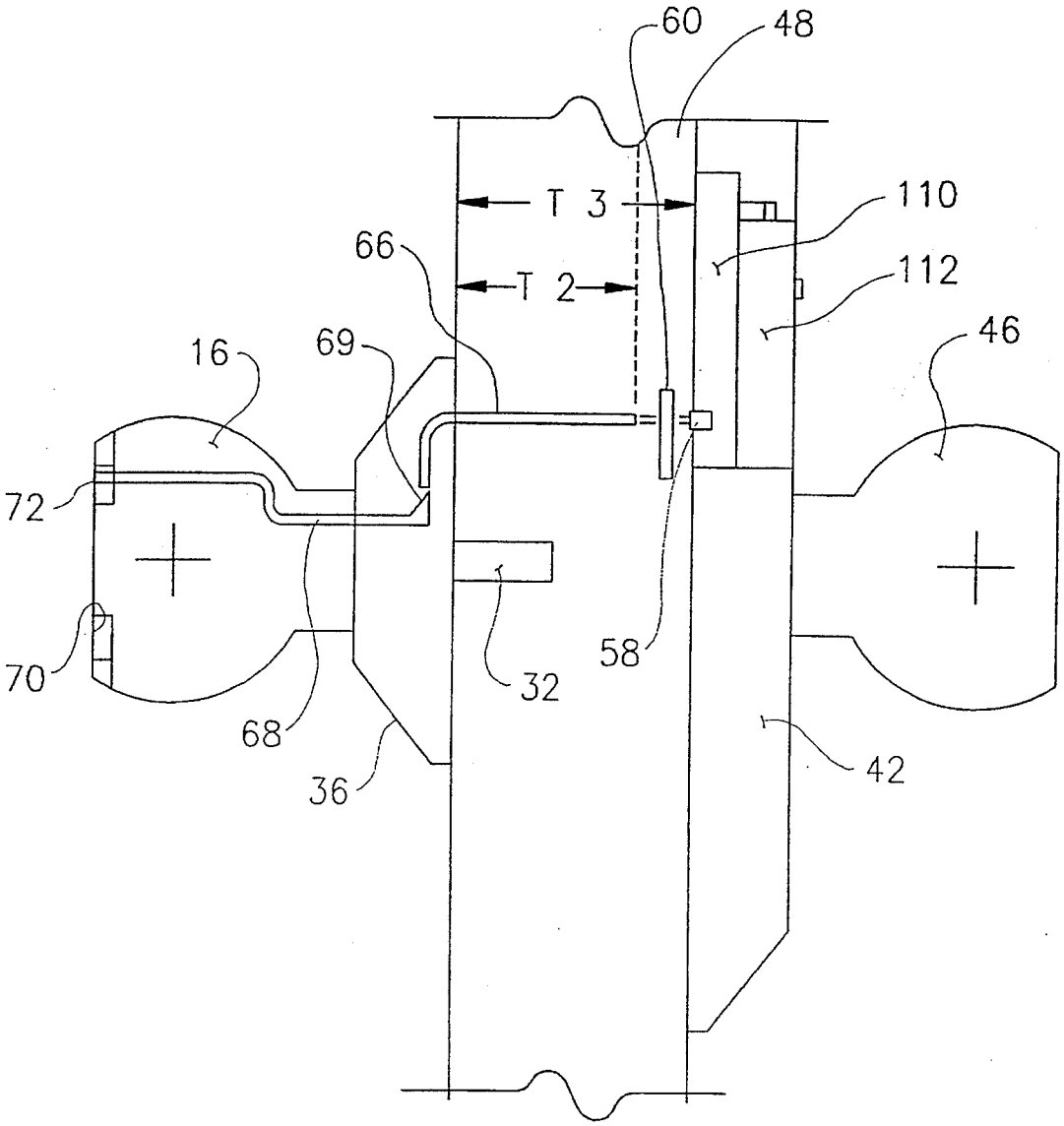
FIG. 2 is a schematic representation illustrating the lockset assembly secured to a door.

Secured to the door is a support assembly which is secured to and extends through the door. This support assembly includes the exterior rose liner 30 which has a pair of fastener receiving stems 32, a cylindrical shield 34 which slides onto the stems and locates against the rose liner and a rose cover 36 to dress the rose liner 30. The support assembly also includes an interior cover 38, an interior rose liner 40 and a cover 42 (the latter two could be one piece). The interior cover 38, the rose liner 40 and interior cover 42 have a pair of holes through which screws 44 can pass to enter the stems 32 on the exterior rose liner 30 to clamp the support assembly to a door 48 (FIG. 2). The spindle assembly interconnects the exterior 16 and interior 46 operators.

As shown in FIG. 2, the lockset is secured to a door 48 of a building like a residence or business, which can have a thickness which can vary from thickness T1 to thickness T2. The light source which may be an L.E.D. 58 is secured within the interior rose and will be operated for a set time (x minutes) before a person arrives at the door. The time will be selected to give the person enough time to open the door. The emitted light, which optionally can be further focused by a suitable lens 60 is transmitted to an exterior rod shaped light pipe assembly which is made from clear plastic and which includes a stationary rod shaped portion 66, a rod shaped portion 68 which is part of the exterior knob assembly and the annular portion 19 which emits light from its front annular flat surface 72. The input end 69 of the rod shaped portion 68 may be inclined by an angle of 45° to increase the amount of light received.

Figure 3:
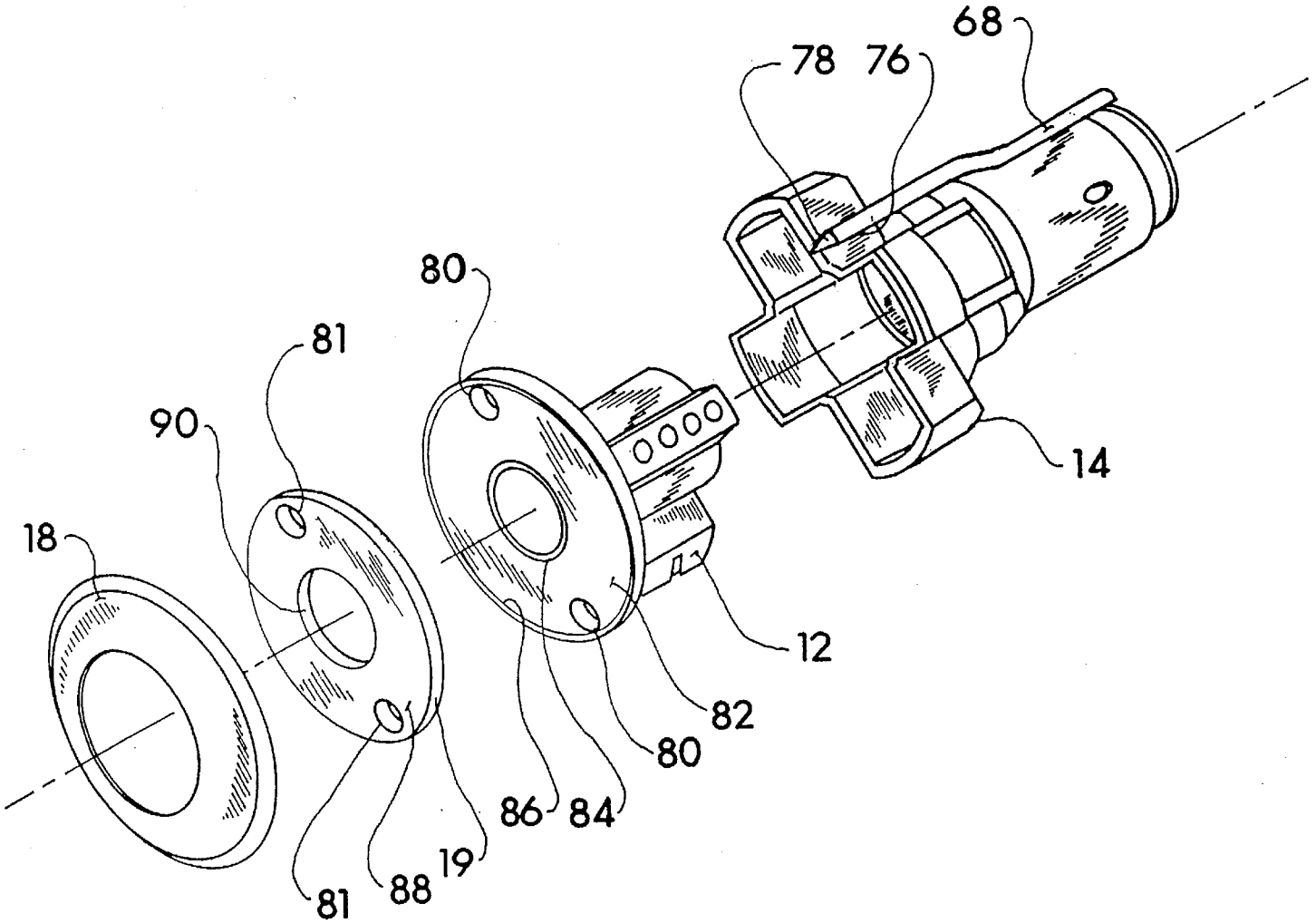
FIG. 3 is an oblique view of a portion of the structure shown in FIG. 1 separated for clarity.

As can be seen from FIG. 3, the front end of the stationary portion of the exterior light pipe assembly 68, is captured within a suitably shaped notch 76 at the top of the insert and projects a short distance beyond the top of the insert terminating with a 45° surface 78 facing tangentially. The projecting end 78 of the light pipe 68 passes through a hole 80 in the end face 82 of the insert 12 and enters into a hole 81 in the transparent annular portion 19 which is located on the end of the end face between an inner annular post 84 and an outer annular flange 86. The 45° inclined surface on the light pipe maximizes light transmission to the annular portion 19. The outer surface of this annular portion 19 has an annular outside recess 88 to receive the cylinder cover 18 thereby defining with the cover a smooth exterior surface including the cover and an exposed inner annular visible ring 90 of the annular portion 19. Optionally, the annular portion 19 can have all of its non exposed surfaces painted or colored white to maximize the amount of light that will leave through the annular exterior visible ring 90. As can be seen from FIG. 5, the other (inner) end of the rod shaped light pipe 68 is located within a slot 92 in the insert 12. When the exterior knob 16 is placed over the insert, the knob will fully capture both ends of this light pipe.

The exterior stationary light pipe 66 extends within and axially from the end of a third tubular housing or stem 100 which is fabricated as a part of the cylindrical shield (this stem could alternately be part of the exterior rose liner), through the exterior rose liner 30 to its exterior face 62, where it bends almost 90° and is partially captured within a U-shaped slot 102 (half shown) on the face. When the rose cover 36 is secured in place, the partially captured outer end of the stationary exterior light pipe 66 will be fully captured.

Figure 4:
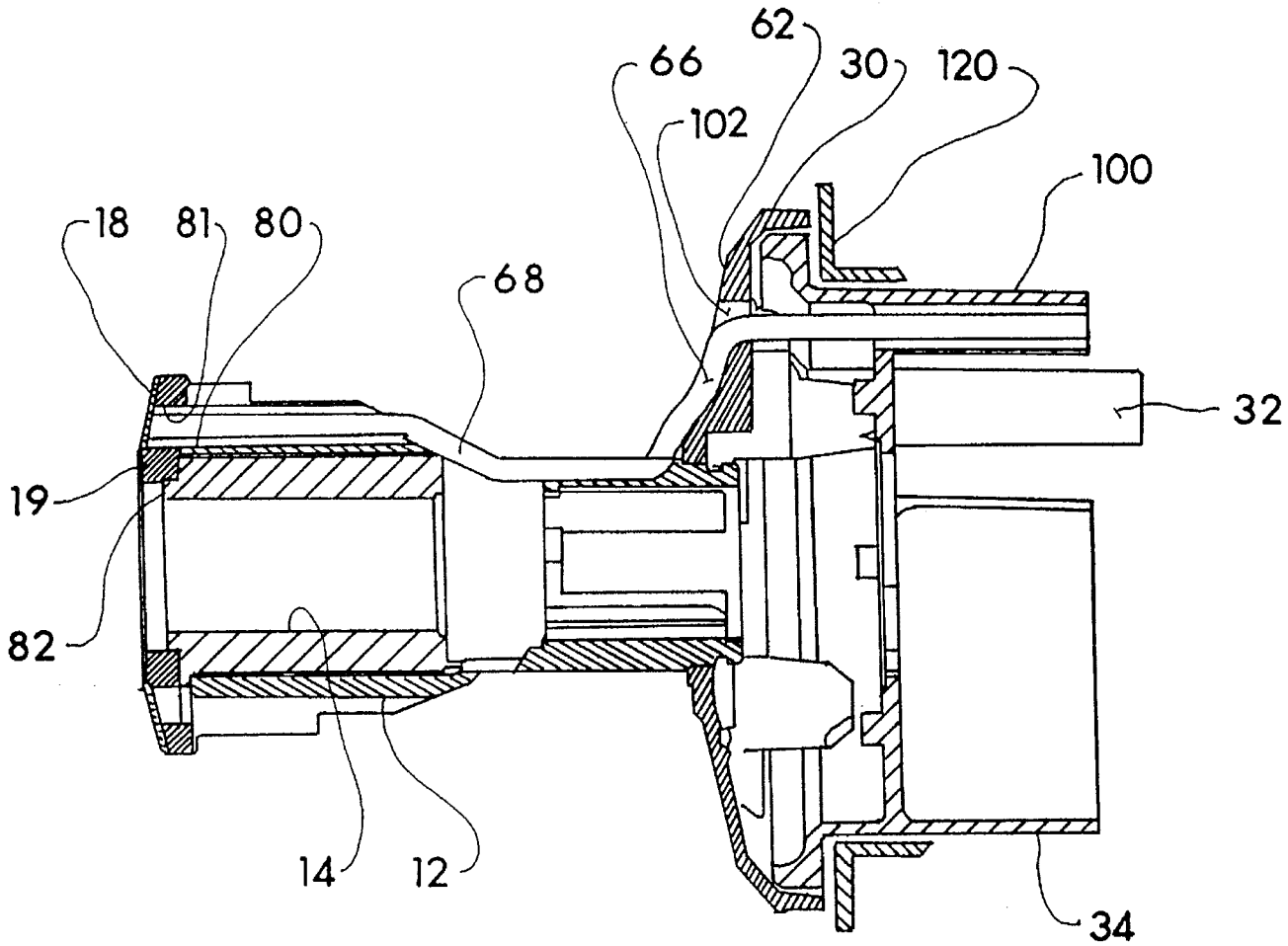
FIG. 4 is a side elevational view of the assembled exterior rose cover and insert with the parts in their normal orientations.
Figure 5:
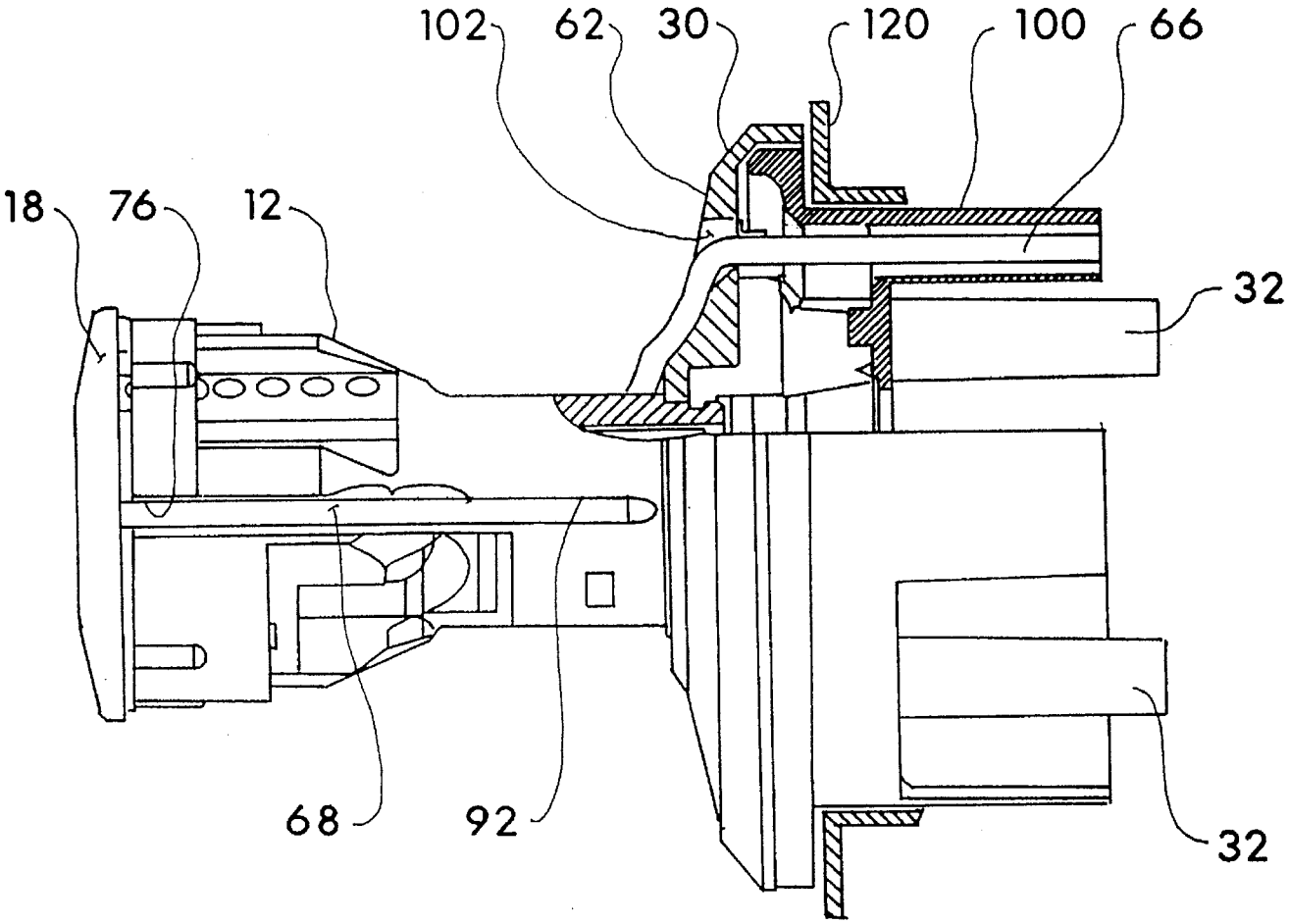
FIG. 5 is a view similar to that of FIG. 4 with the insert rotated relative to the rose cover, to the door open position.

FIG. 5, which is similar to FIG. 4, shows the insert rotated to the door open orientation. As can be seen from FIG. 5, when the operator is rotated to turn the insert to this position, a discontinuity will exist in the exterior light pipe assembly. The end of the stationary light pipe 66 will no longer see the light being transmitted from the inner end of the normally associated light pipe 68.

The L.E.D. 58 is secured to the receiver housing 110 (FIG. 2) which is secured to the interior cover 42 (an access door 111 may be provided). The receiver and the L.E.D. are powered by a battery 112 which is also located within this cover.

Figure 6:
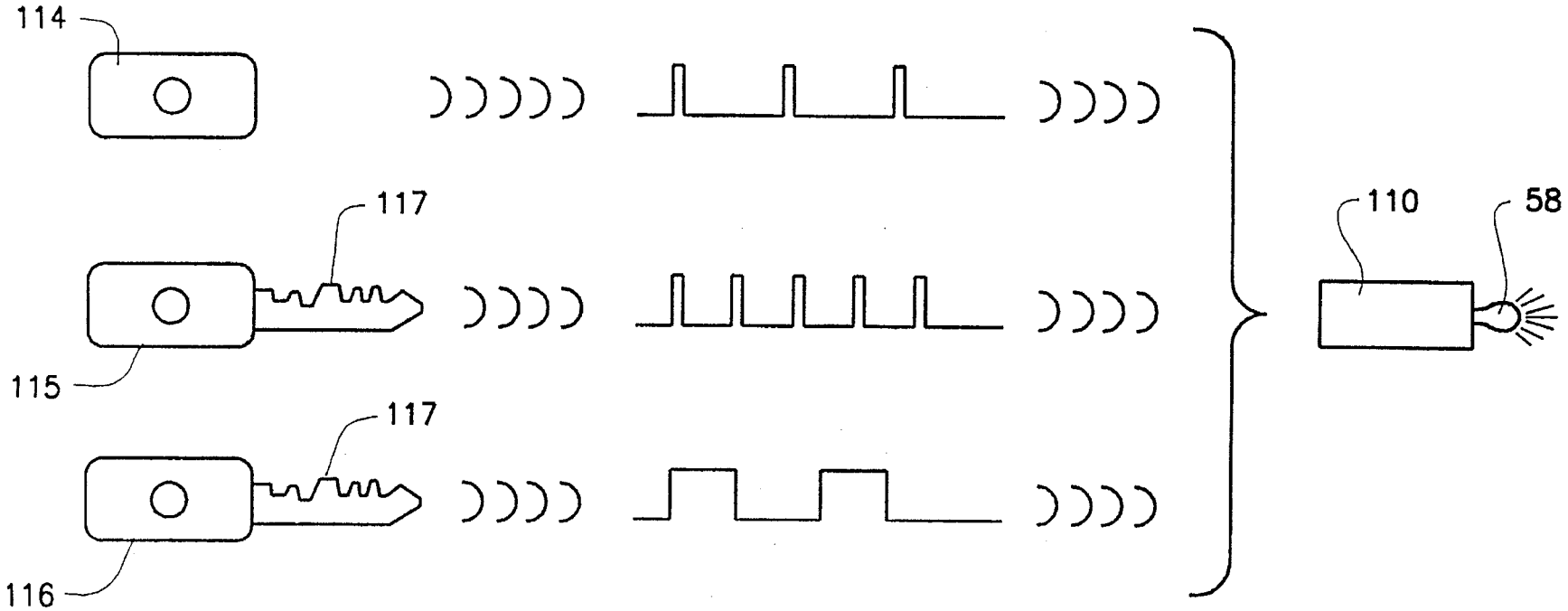
FIG. 6 is a schematic representation of the operation of light operating structure made in accordance with the teachings of the present invention.

FIG. 6 shows three RF transmitters 114, 115, 116. For example, transmitter 114 might be a garage door opener which would not have a key portion. Transmitter 115 might be a transmitter sold with the lockset assembly having a key portion for opening the lock and transmitter 116 might be a transmitter owned by a car owner for operating an alarm system, etc., which could have a key portion for opening the car door.

While the garage door opener and the car transmitter have an output signal having a permanent code, the lockset transmitter does not have a permanent code but rather issues a pulse train. As shown in FIG. 6, these three signals are different, i.e., only the garage door transmitter can open the garage door and only the car transmitter can open the car door. Any of these signals, when received by the receiver, will operate the L.E.D. 58.

Figure 7:
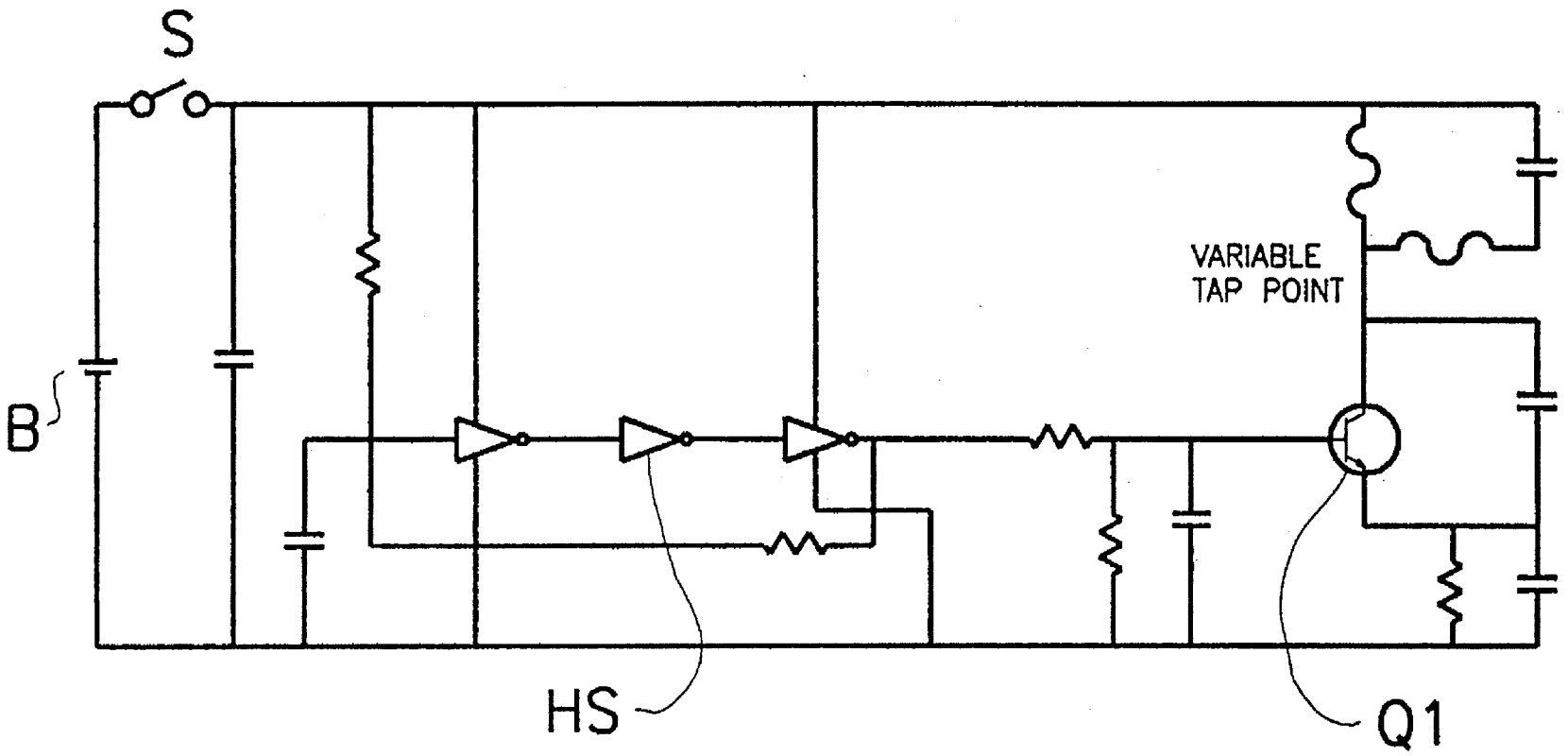
FIG. 7 is an electronic diagram of the transmitter of the system.

FIG. 7 illustrates the transmitter circuit in the lockset key. When a person depresses the button or switch S, the battery B operates a Hex Schmitt inverter HS which drives an RF transistor Q1 to transmit a signal in the form of a pulse train which conforms to FCC regulations (§15.231). These regulations encourage designers to use a relatively low duty cycle in transmitted pulses. Generally, a reasonable range of "on" pulse times is in the range of 0.1 to 0.8 millisecond and the "off" time should be in the range of 1 to 4 milliseconds. Such a pulse train is not a coded signal since in a coded signal, the duration of an "on" pulse can be varied to convey digital information.

Figure 8:
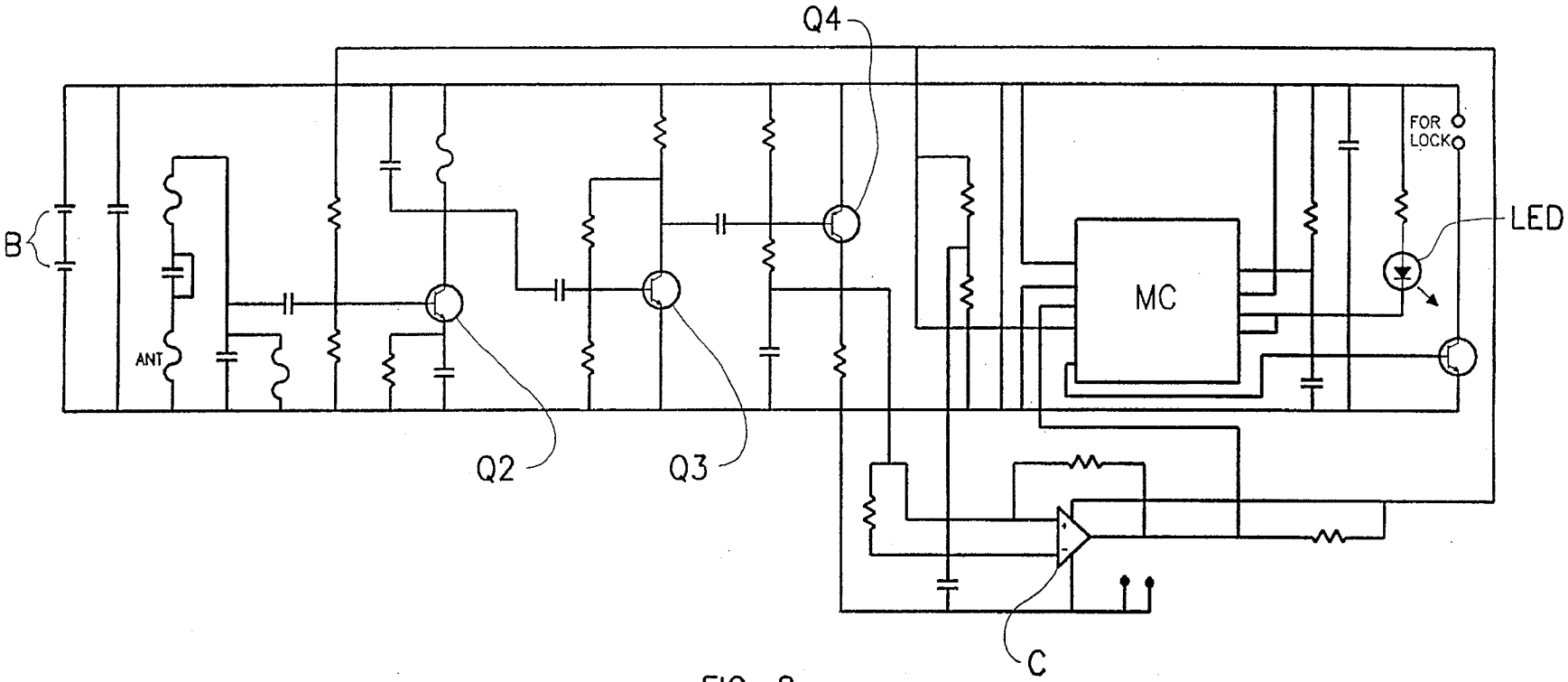
FIG. 8 is an electronic diagram of the receiver of the system.

The receiver illustrated in FIG. 8 is designed to measure any signal pulses received and to look for an "on" pulse width followed by an "off" pulse width that is within these ranges. The signal from a radio transmitter that has a steady signal (as compared to an asymmetric signal) will be ignored as will signals that do not conform to the desired range of asymmetric signals. The design is intended to recognize as valid signals both the pulse train and the coded signals from conventional garage door openers and automotive entry systems since these generally produce asymmetric signals within the desired range.

Figure 9:
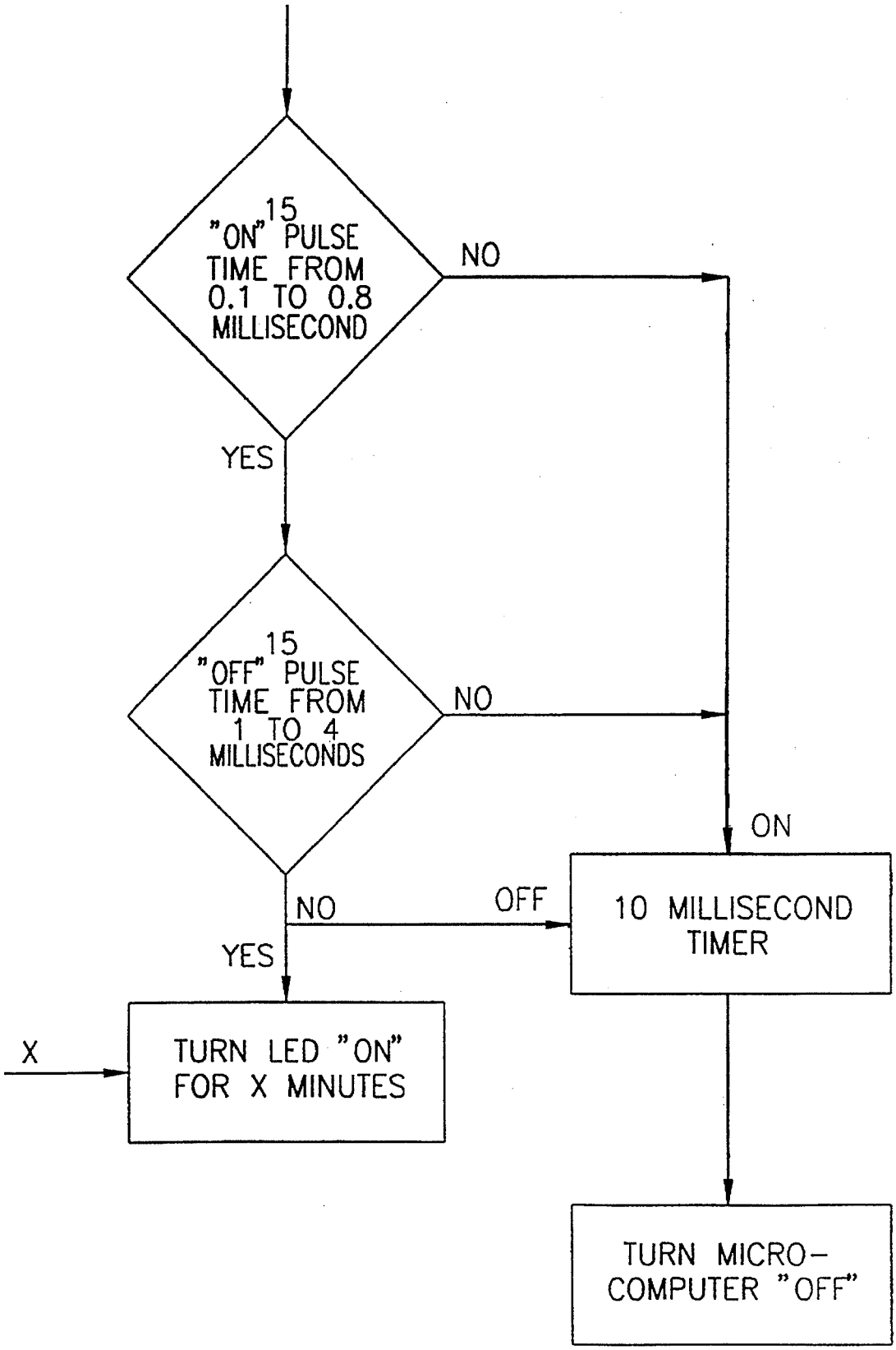
FIG. 9 is a logic diagram illustrating the control algorithm.

Referring to the preferred embodiment of the receiver illustrated in FIG. 8, the circuit is powered by a pair of double or triple A alkaline cells or batteries B. Transistor Q2 and the circuits around it are an RF preamplifier. Transistor Q3 is a demodulator to detect the radio frequency energy when it is present. It is left on all the time at a very low power consumption since it would be difficult to turn it on rapidly enough. Q4 is a low frequency amplifier to increase the level of the detected signal. A comparator C compares the level of the detected signal with a long time average signal to remove the effect of any steady signals such as from a broadcast radio or TV station. The comparator output is fed to an input port pin on a microcomputer MC which is turned on approximately every 100 milliseconds. When the microcomputer turns on it turns on the RF preamplifier and the comparator. After enough time to allow the circuits to settle (approximately 1 millisecond) the microcomputer starts timing the signals at the output of the comparator and determines whether the signals are within the acceptable range, i.e., "on" pulses in the range of 0.1 to 0.8 millisecond and "off" pulses in the range of 1 to 4 milliseconds (FIG. 9). If no signal is detected in 10 milliseconds, the system is turned off again. If the signal is within the acceptable range the microcomputer will turn on the L.E.D. for a selected period of time (x minutes) which is selected to provide enough time for a person to reach and open the door before the light is turned off.

The antenna ANT shown in FIG. 8, may either be an electronic antenna or it may be the lock itself. If the antenna is the lock itself, it may be necessary to isolate the lock from the door and doorway with an insulating plastic sleeve 120 (FIGS. 4 and 5) located between the exterior support assembly and the door and similarly between the interior support assembly and the door. Preferably, the latch bolt assembly (not shown) would then be electrically isolated also.

While in the preferred embodiment, the receiver and battery are on the interior of the door a) the receiver and battery could both be on the exterior of the door;

b) the receiver could be on the exterior of the door with the battery on the interior; or c) the L.E.D. could directly illuminate the ring shaped light pipe or light it via one or more light pipes.

What is claimed is:

1. A door lock assembly comprising a lock plug having a key receiving opening, selectively operable light source means for illuminating said key receiving opening, RF receiver means for reproducing a received pulsed RF signal and means for determining whether said reproduced RF signal is within an acceptable range of asymmetric patterns of "on" pulse times followed by "off" times selected to include a plurality of different asymmetric patterns and means for operating said light source means for a selected period of time when said determining means determines that said reproduced RF signal is within said acceptable range.

2. A door lock assembly according to claim 1, wherein said acceptable range of asymmetric patterns includes "on" pulse times of approximately 0.1 to approximately 0.8 millisecond and "off" times of approximately 1 to approximately 4 milliseconds.

3. A door lock assembly according to claim 1, wherein said received pulsed RF signal is a pulse train.

4. A door lock assembly according to claim 3, wherein said received pulsed RF signal is a coded signal.

5. A door lock assembly according to claim 4, wherein said light source means includes an L.E.D.

6. A door lock assembly according to claim 5, wherein said light source means further includes an annular ring of transparent material extending around said key receiving opening and transparent rod means for receiving light form said L.E.D. and delivering the received light to said annular ring.

7. A door lock assembly comprising a lock plug having a key receiving opening, selectively operable light source means for illuminating said key receiving opening, RF receiver means for reproducing a received pulsed RF signal defined by alternating "on" pulse and "off" times and means for determining whether said reproduced RF signal has an acceptable "on" pulse time followed by an acceptable "off" time, means for operating said light source means for a selected period of time when said determining means determines that said "on" pulse and "off" times are acceptable, and RF transmitter means for transmitting a pulse train defined by acceptable "on" pulse and "off" times.

8. A door lock assembly according to claim 7, wherein said acceptable "on" pulse time is from approximately 0.1 to approximately 0.8 millisecond and said acceptable "off" time is from approximately 1 to approximately 4 milliseconds.

9. A door lock assembly according to claim 8, wherein said light source means includes an L.E.D.

10. A door lock assembly according to claim 9, wherein said light source means further includes an annular ring of transparent material extending around said key receiving opening and transparent rod means for receiving light from said L.E.D. and delivering the received light to said annular ring.

* * * * *